United States Patent [19]

Takatori et al.

[11] 3,936,361

[45] Feb. 3, 1976

[54] IMAGE RECORDING MEMBER

[75] Inventors: Yasushi Takatori; Mitsunobu Nakazawa, both of Tokyo, Japan

[73] Assignee: Canon Kabushiki Kaisha, Tokyo, Japan

[22] Filed: Mar. 26, 1974

[21] Appl. No.: 454,979

[30] Foreign Application Priority Data

Mar. 26, 1973 Japan ..... 48-34332
Mar. 26, 1973 Japan ..... 48-34333

[52] U.S. Cl. ..... 204/2; 117/36.7
[51] Int. Cl.[2] ..... B21H 1/20; B41C 3/08
[58] Field of Search ..... 204/2; 346/76 R, 135; 117/36.8, 36.9, 36.7

[56] References Cited

UNITED STATES PATENTS

| | | | |
|---|---|---|---|
| 3,467,658 | 9/1969 | Lipka | 260/268 |
| 3,514,310 | 5/1970 | Kimura | 117/36.8 |
| 3,789,425 | 1/1974 | Matsushima | 346/135 |
| 3,792,481 | 2/1974 | Nagashima | 346/76 R |

*Primary Examiner*—T. M. Tufariello
*Attorney, Agent, or Firm*—Fitzpatrick, Cella, Harper and Scinto

[57] ABSTRACT

A recording member having a recording layer comprising an electrically conductive agent, an image forming agent, and a binder wherein the electrically conductive agent consists of at least one zeolitic water containing compound.

21 Claims, 3 Drawing Figures

IMAGE RECORDING MEMBER

BACKGROUND OF THE INVENTION

1. Field of the Invention

The present invention relates to image recording members for recording an image by applying electricity, which are usable in recording, such as receiving signals of facsimiles output of computer and its terminal equipments and datum of various kinds of measuring apparatuses for industry, medicine, business and the like.

2. Description of the Prior Art

Recording of an electrical signal as an image has been increasing annually with development of facsimile and the like. Some conventional widely used methods are for example electrical discharge recording, electrolyte recording and like methods.

In the electrical discharge recording method, a white pigment surface layer is provided on a black electrically conductive layer or an electrically conductive layer such as aluminum is provided on the black layer, and an electrical discharge is applied from a recording needle (hereinafter referred to as a stylus) to remove the surface pigment so that the black layer may be revealed, forming an image. On the other hand, in accordance with the electrolyte recording method, a paper is impregnated with an electrolyte solution, kept in a wet state, and subjected to application of electricity and thus an image can be obtained. The resulting image is a colored substance formed by reaction of an ionized stylus metal and an electrolyte or a colored decomposition product formed by electrolysis of electrolyte by electricity applied from the stylus.

According to the electric discharge recording method, the surface layer is perforated by discharge heat generated by the stylus and therefore the recording method has several disadvantages such that an extremely strong irritating odor is generated, perforation dust off the surface layer is scattered, and consumption of the stylus is large. Furthermore, since the black layer is apt to be revealed by mechanical forces such as bending, pressure and so on, the paper easily becomes dirty. Furthermore, the surface layer is made thin so that discharge is easily generated and thus the black layer cannot be completely covered. Therefore, the paper is not white, but grey, resulting in bad appearance.

On the other hand, since the electrolyte recording method is a wet type method, the durability of the recording paper is poor and image properties are deteriorated by blotting. In addition, the paper is subject to deformation such as wrinkles after recording. These disadvantages are inherent to the wet type of recording method.

A dry electrosensitive recording sheet is described in Japanese Pat. Nos. 22341/1963 and 29630/1969 wherein electrically reducable metal compounds are dispersed in an insulative resin and reduced to free metals by application of electricity, thereby forming an image. In that case, most of the metal compounds of relatively high electric conductivity are colored and the non-colored metal compounds are of such low conductivity that they require chemical and physical treatments prior to the application of electricity. However, such treatment causes coloration of the metal compounds, thereby increasing the original color density of the recording paper. At the stage of application of the electricity, discharge is caused and there occur disadvantages such as generation of offensive odor is caused and consumption of the stylus is large. Furthermore, Japanese Pat. Nos. 5476/1967 and 13239/1967 disclose a method wherein an electrically conductive layer is formed on white or transparent compounds such as silica and the like by means of evaporation-deposit and thereafter they are dispersed in a matrix and subjected to application of electricity. However, this method has encountered some serious problems in the treatment stage. As stated above, recording members effective for forming an image have not been proposed.

SUMMARY OF THE INVENTION

It is a main object of the present invention to provide image recording members whose recording layer is improved with respect to conductivity.

It is another object of the present invention to provide image forming members which are seemingly in a completely dry condition and are stable regardless of high and low humidity.

It is a further object of the present invention to provide image recording members which are capable of responding to slight changes in quantity of electricity applied and which provide recorded images of high quality and furthermore which are excellent in reproduction of tone of the image.

It is a further object of the present invention to provide image recording members which are of high white background and of excellent touch.

It is a further object of the present invention to provide image recording members which are produced by an extremely simple procedure.

It is a further object of the present invention to provide image recording members which are excellent in storage stability.

It is a further object of the present invention to provide image recording members which are non-toxic and of high safety at the stages of production and use.

It is a further object of the present invention to provide recording methods which are capable of responding to slight changes in the quantity of electricity applied, and which provide recorded images of excellent quality and of excellent tone reproduction.

The present invention is directed to recording members provided with recording layers which contain at least an electrically conductive agent, an image forming agent, and a binder, characterized in that the conductive agent contains zeolitic water. Furthermore, the present invention is characterized by applying electricity to recording layers which contain at least zeolitic water containing compound, image forming agents, and binders, to form an image.

DESCRIPTION OF THE PREFERRED EMBODIMENTS

Figure 1:
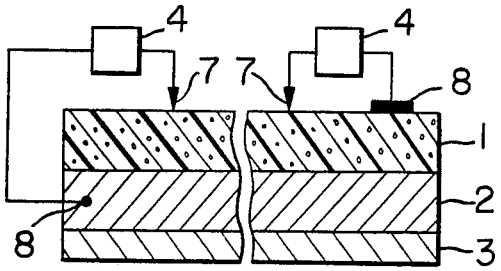
FIGS. 1, 2, and 3 schematically illustrate the structure of an image recording member of the present invention and a recording method.

The term "zeolitic water containing compound" as used herein mean those compounds satisfying the following requirements.

1. The compound contains water (zeolitic water) slightly combined with a "cavity" within the structure thereof. Even at the state that the compound contains a sufficient zeolitic water, it is free from stickiness due to deliquescenece and efflorescence such as seen with sodium chloride and the like, and it is seemingly kept in dry condition.

2. Even after zeolitic water contained in the compound is completely removed by means such as heating and reduced pressure, the structure is free from deterioration.

3. The compound from which zeolitic water is completely removed, re-absorbs water promptly under low humidity condition and recovers the original saturated condition.

4. The zeolitic water coexists with various kinds of ions that the compound contains and thus the compound exhibits excellent conductivity.

As stated above, the zeolitic water containing compound exhibits highly specific physical properies when the compound is dispersed in a binder or when it is used alone, it exhibits substantially identical properties. The present invention is based upon the specific properties of the zeolitic water containing compound. Other properties of zeolites are more fully discussed in C. B. Amphlett, *Inorganic Ion Exchangers*, Chapter Three, (1964).

The representative examples of these compounds may be given below.

A typical example of such compounds is natural zeolite. It is called aluminum silicate and represented by the general formula:

$$[M^{2+}, (M^{+})_2]\ O\ .\ Al_2O_3\ .\ mSiO_2\ .\ nH_2O\ (3 \leqq m \leqq 10)$$

$M^{2+}$ and $M^{+}$ indicate, respectively, divalent and monovalent metal ions and they are usually $Ca^{2+}$ and sometimes $Sr^{2+}$,$Ba^{2+}$ and $K^{+}$ which are replaceable with other cationic ions. These zeolites contain a specific "cavity" in a three dimensional structure, and the above replaceable cations are held in this cavity with a water molecule. Other organic solvents may be absorbed in the cavity, and solvents of high polarity are selectively absorbed. There are a number of synthetic zeolites which have substantially the same three-dimensional structure as natural zeolite and which are identical to zeolite with regard to its basic properties. Furthermore, there are natural or synthetic compounds which have chemical compositions completely different from zeolite although they have the same basic properties as zeolite, that is, they have a "cavity" and do not change their structures in absorption and desorption of water. They are called zeolite-like compounds and also are used in the present invention.

Zeolites as used herein include natural as well as synthetic compounds and may be classified as below.

| | | |
|---|---|---|
| (1) Analcime Group: | | |
| Analcite | | $NaAlSi_2O_6.H_2O$ |
| Pollucite | | $(Cs,Na)AlSi_2O_6.\times H_2O$ $(\times<10)$ |
| Viseite | | $Ca_{10}Na_2Al_{10}Si_6P_{10}(H_3)_{12}(H_2O)_{16}.O_{96}$ |
| Kehoesite | | $Zn_{5.5}Ca_{2.5}Al_{16}P_{16}(H_3)_{16}(H_2O)_{32}O_{96}$ |
| (2) Sodalite Group: | | |
| Hydrosodalite | | $Na_8(Al_6Si_6O_{12})(OH)_2$ |
| Faujasite | | $Na_{28.6}Ca_{14.8}(Al_{57.6}Si_{134.4}O_{384})\ 262.3H_2O$ |
| Molecular sieve | *A | $Na_{12}(Al_{12}Si_{12}O_{24})Na\ AlO_2.\ 29H_2O$ |
| " | *X | $Na_2(Al_2Si_{2.8}O_{9.6}).\times H_2O$ $(\times\approx 6)$ |
| " | *Y | $Na_2O.Al_2O_3.3\sim 6\ SiO_2.\times H_2O$ |
| " | *SK | substantially identical to faujasite |
| (3) Chabazite Group: | | |
| Chabazite | | $(Ca.Na_2)Al_2Si_4O_{12}.6H_2O$ |
| Gmelinite | | $(Na_2Ca)Al_2Si_4O_{12}.6H_2O$ |
| Erionite | | $(Ca.Mg.Na_2.K_2).Al_2Si_4O_{12}.6H_2O$ |
| Levynite | | $Ca(Al_2Si_4O_{12}).6H_2O$ |
| Molecular sieve | *R | the same as Chabazite |
| " | *S | the same as Gmelinite |
| " | *T | the same as Elionite |
| (4) Natrolite Group: | | |
| Natrolite | | $Na_2(Al_2Si_3O_{10}).2H_2O$ |
| Mesolite | | $Na_2Ca_2(Al_6Si_9O_{30}).8H_2O$ |
| Scolecite | | $Ca(Al_2Si_3O_{10}).3H_2O$ |
| Thomsonite | | $NaCa_2(Al_5Si_5O_{20}).6H_2O$ |
| Edingtonite | | $Ba(Al_2Si_3O_{10}).4H_2O$ |
| Gonnardite | | $Na_2Ca(Al_4Si_6O_{20}).6H_2O$ |
| Rhodesite | | $KnaCa_2(H_2Si_8O_{20}).5H_2O$ |
| Mountainite | | $KNa_2Ca_2(HSi_8O_{20}).5H_2O$ |
| (5) Harmotome Group: | | |
| Harmotome | | $Ba_2(Al_4Si_{12}O_{32}).4H_2O$ |
| Phillipsite | | $(K\times Na_{1-\times})_5Al_5Si_{11}O_{32}.10H_2O$ |
| Gismondite | | $Ca(Al_2Si_2O_8).4H_2O$ |
| Molecular sieve *B | | $Na_2(Al_2Si_3O_{10}).5H_2O$ |
| Garronite | | $NaCa_{2.5}(Al_3Si_5O_{16})_2.13.5H_2O$ |
| (6) Mordenite Group: | | |
| Mordenite | | $Na(AlSi_5O_{12}).3H_2O$ |
| D'achiardite | | $(Na_2Ca)_2Al_4Si_{20}O_{48}.12H_2O$ |
| Ferrierite | | $Na_{1.5}Mg_2(Al_{5.5}Si_{30.5}O_{72}).18H_2O$ |
| Zeolon** | | the same as Mordenite |
| (7) Zeolites of non-determined structure | | |
| Heulardite | | $Ca(Al_2Si_7O_{18})6H_2O$ |
| Clinoptilotite | | $Na_{0.95}K_{0.30}Ca_{0.5}(Al_{1.35}Si_{7.05}O_{18})5H_2O$ |
| Stilbite | | $Ca(Al_2Si_7O_{18})7H_2O$ |
| Epistilbite | | $Ca(Al_2Si_6O_{16}).5H_2O$ |
| Brewsterite | | $(Sr,Ba,Ca)Al_2Si_6O_{16}.5H_2O$ |
| Laumontite | | $Ca(AlSi_2O_6).4H_2O$ |
| Yugawaralite | | $Ca(Al_2Si_5O_{14}).3H_2O$ |
| Paulingite | | $(K,Ca,Na)_{120}[(Al,Si)_{580}O_{1160}]690H_2O$ |
| Aschcroftine | | $[KNa(Ca,Mg,Mn)]_{120}(Al_{160}Si_{200}O_{720})320H_2O$ |
| Bikitaite | | $LiAlSi_2O_6.H_2O$ |

All the above compounds are applicable to the invention.

(8) Zeolite-like compounds:

(8 – 1) Zeolite-like silicate

These are not classified as zeolites per se but they contain zeolitic water.

-continued

| | |
|---|---|
| Beryl | $Al_2Be_3[Si_6O_{18}].nH_2O$ |
| Cordierite | $Mg_2Al_3[AlSi_5O_{18}]nH_2O$ |
| Milarite | $KCa_2AlBe_2[Si_{12}O_{30}]0.5H_2O$ |
| Osumilite | $(K,Na,Ca)(Mg,Fe)_2(Al,Fe)_3[(Si,Al)_{12}O_{30}].H_2O$ |
| Hydrated Nepheline | $KNa_3(Al_4Si_4O_{16}).nH_2O$ |
| Cancrinite | $Na_6Ca_6(Al_6Si_6O_{24})CO_3.3H_2O$ |
| Buddingtonite | $NH_4AlSi_3O_8.0.5H_2O$ |
| (8 – 2) Other Zeolite-like compounds | |
| I) Germanate | $M_3[HGe_4(GeO_4)_3O_4].4H_2O$: M is a metal ion. |
| II) Phosphate, Arsenate, | |
| Scorodite | $FeAsO_4.2H_2O$ |
| Pharmacosiderite | $K[Fe_2(OH)_4(AsO_4)_3].6\sim7H_2O$ |
| III) Water containing metal oxide | |
| Psilomelane | $(Ba,H_2O)_2,Mn_5O_{10}$ |
| IV) IV) structure complex | |
| Prussian blue | $M_3[Fe(CN)6]_2.12H_2O$,(M-Mn,Fe,Co,Ni,Zn,Cd) |
| Weddellite | $CaC_2O_4.(2+\times)H_2O$, ($\times\leqq0.5$) |

*Synthetic Zeolite manufactured by Union Carbide Co.
**manufactured by Norton Co.

The above listed compounds are all applicable to the present invention as well as those compounds which have large "cavity" volume and a high water content, thereby exhibiting good conductivity, are preferred.

The image forming agents as used herein are those capable of forming an image in response to a change of energy by application of electricity. Any known compound can be employed. For example, an oxidation type of color former, reduction type of color former, PH indicator, heat sensitive color former and the like can be used. In a type of color former as the leuco compound of diphenylmethane dye, there may be used Michler's methane bases such as bis (P-dimethylaminophenyl) methane, 9,9′-diethyl-6,6′-dichloro-3,3′-dicarbazoylmethane, (9-ethyl-6-methyl-3-carbazoryl)-P-dimethylaminophenylmethane and the like and leucoauramines such as leucoauramine, N,N-diethylleucoauramine, phenylsulfoneamide-bis-(P-dimethylaminophenyl)methane, bis (P-dimethylaminophenyl) benzotriazylmethane, bis (p-diethylaminophenyl) morphonylmethane and the like. As the leuco compound of triphenylmethane dye, there may be used diaminotriphenyl methanes such as leuco-malachite Green, 3,3′-dicarbazolylphenyl methane and the like, triamino-phenylmethanes such as leuco Crystal Violet, 9,9′,9′′-triethyl-3,3′,3′′-tricarbazolylmethane and the like, and hydroxy-triphenylmethanes such as bis (3-methyl-4-hydroxy-5-carboxyphenyl)-2,6-dichloro-phenylmethane, bis (3-methyl-4-hydroxy-5-carboxyphenyl)-4-diethylaminophenylmethane and the like. Furthermore, there may be used leuco compounds of xanthene such as 3,6-di (dimethylamino) xanthene, leuco compounds of acridine dye such as 3,6-di-amino-2,7-dimethyl-9-phenyl-acridane, 3,6-di (dimethylamino) acridane and the like, leuco compounds of azine dyes such as 2-methyl-3-amino-7-dimethyl amino-5,10-dihydrophenazine, 3,7-diamino-5-phenyl-5,10-dihydrophenazine and the like, leuco compounds of oxazine dyes such as 3,7-di (dimethylamino) phenoxazine and the like, and leuco compounds of thiazines such as 3,7-di (dimethylamino) phenothiazine and the like.

Moreover, reductants of indigo and indigoid dye, leucoferrocyanine, and leuco base fast colors of paraquinones such as benzoquinone dyes, naphtoquinone dyes, antraquinones and the like also may be used. Aromatic amino compounds such as p-aminodiphenylamine, diphenylbenzizine, oxidation bases which produce oxidation dyes and phenols such as 4-methoxy-1-naphtol, 1,5-dihydroxynaphthalene, and the like, and reductants of sulfide dyes such as 2-mercapt-3-hydroxy-7-dimethylaminophenothiazine and the like may be used.

As the reduction type of color former, there may be used tetrazolium salts such as triphenyltetrazolium chloride, ditetrazolium chloride and the like, long chain aliphatic acid ion salts such as ferric stearate, and the like, organic acid nobel metal salts such as silver vehenate, silver stearate, and the like, oxalic acid metal salts such as silver oxalate, nickel oxalate and the like, metal carbonates such as manganese carbonate, cobaltous carbonate and the like, metal chlorides such as nickel chloride, copper chloride, and the like, and heterocyclic quaternary ammonium salts which are capable of forming anhydro salts by reduction such as 1-methyl-2-2′,4′-dinitrobenzylpiridium p-toluene sulfonate, 1-methyl-4-chloroquinaldium sulphate and the like. Metal compounds such as molybdenum trioxide, thorium oxide, cerium oxide, phosphotungstic acid, phosphomolibdenum acid, ammonium phosphomolibdenate and the like, also may be used.

As the heat sensitive color former there may be used such single heat sensitizers as indole derivatives-, phrolone derivatives-, and substituted amino dithio formic acid heavy metal salts, and two-component heatsensitizers such as long chain aliphatic acid ion salts (such as ferric steatate)-phenols (such as tannic acid, ammonium salicylate), organic heavy metal salts (such as nickel acetate and the like)-alkali earth metal sulfides or organic chlates (such as diphenylcarbazone), organic acid nobel metal salts (such has silver behenate)-aromatic organic reductant (such as hydroquinone, protocatechuic acid), higher aliphatic heavy metal salts (such as ferric stearate)-desubstituted dithiocarbamine acid zinc derivatives (such as zinc dibutylthiocarbamate), and the like. In addition, there may be used a two component based color forming heat sensitive agent such as combinations of one member selected from color formable lactone compounds such as Crystal Violet lactone, 3-dimethyl-amino-6-methoxyfuroorane; color formable lactam compounds such as Rhodamine B lactam; leuco compounds of dyes such as leuco Crystal Violet, leuco Malachite Green; and spiropyran compounds such as 1,3,3-trimethylindolyno-8′-methoxybenzopyryl spiran, 1-amyl-3,3-dimethyl indolyno-8′-ethoxybenzopyryl-spiran and one member selected from acidic compounds such as bisphenol A, α-naphthol, and palmitic acid.

There is known in the art a method in which iodo compounds such as potassium iodide is included in a recording layer and iodo is electrically generated, thereby forming color due to starch iodide reaction and thus a visible image can be obtained, and a method in which iodo compounds, amines, and their leuco derivatives are included in a recording layer, and after electrically liberating iodine, the amine and its derivative are reacted with the iodine, and thus an image is recorded. These methods are also applicable to the present invention.

Binders as used herein include gelatine, natural high polymeric compound such as starch; cellulose derivatives such as cellulose nitrate, carboxy methyl cellulose and the like; half-synthetic polymers such as natural rubber plasticizer, for example, chlorinated rubber, cyclized rubber and the like; polymerization type of synthetic polymers such as polyisobutylene, polystyrene, terpene resin, polyacrylic acid, polyacrylic ester, polymethacrylic ester, polyarylonitrile, polyacrylamide, polyvinyl acetate, polyvinyl alcohol, polyvinyl pyrrolidone, polyacetal, polyvinyl chloride, polyvinylpiridine, polyvinyl carbazole, polybutadiene, styrene-butadiene copolymer, butyl rubber, polyoxymethylene, polyethylene imine, polyethyleneimine hydrochloride, poly (2-acryloxyethyl dimethylsulfonium chloride), and the like; condensation polymerization type of polymers such as phenol resin, amino resin, toluene resin, alkyd resin, unsaturated polyester resin, allyl resin, polycarbonate, polyamide resin, polyether resin, silicone resin, furan resin, thiocol rubber and the like; and addition polymerization type of polymers such as polyurethane, polyurea, epoxy resin and the like.

The recording members of the present invention are prepared in the following manner.

The zeolitic water containing compound, image forming agent and binder (if necessary, together with pigment, color controlling agent and other additives) are preferably uniformly dispersed and the dispersion is placed on a suitable substrate by coating, dipping, or like methods to form a recording layer. The zeolitic water containg compound is generally used in an amount of 30 to 98% by weight based upon the total weight of the recording layer, and preferably 50 to 95% by weight, and more preferably 70 to 90% by weight. However, the present invention is not limited to them.

As the substrate, there can be used paper, resin film, conductive material such as metal film treated paper, metal vapor depositted paper, metal powder coated paper, carbon treated conductive paper, and the like.

The present invention will be described in more detail with reference to the drawings.

Figure 2:
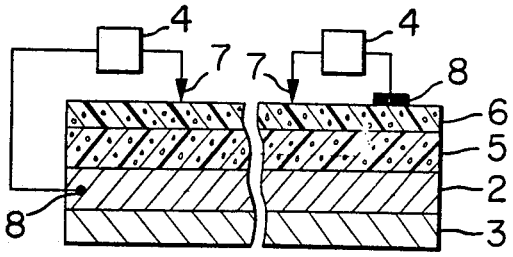
Figure 3:
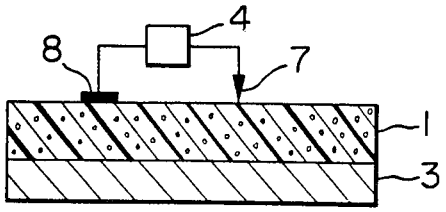

FIGS. 1 to 3 illustrate embodiments of the recording members of the present invention and also schematically illustrate recording method using the recording members.

FIG. 1 shows a recording sheet comprising a recording layer 1, a conductive layer 2 and a substrate 3. The recording layer 1 contains at least a zeolitic water containing compound, an image forming agent and a binder. FIG. 2 shows a recording sheet in which a conductive layer 5 is prepared by removing the image former from the composition of the recording layer 1 of FIG. 1 and an image forming layer 6 contains at least an image forming agent. In this case, the layers 5 and 6 combined to form the recording layer 1. FIG. 3 shows a recording sheet comprising a substrate 3 and the recording layer 1. In FIGS. 1 to 3, 4 indicates a power source and an electrode 8 may be connected directly to the conductive layer or the recording layer, or the image forming layer. Polarity of voltage applied to stylus 7 may be either positive or negative and the current may be alternating current.

EXAMPLE 1

Two grams of leuco-malachite green, 30 grams of faujasite type synthetic zeolite (manufactured by Union Carbide Co. under the trade name of Molecular Sieve 13X), 10 grams of titanium oxide of rutile type titanium oxide, 10 grams of polyvinyl butyral (degree of polymerization of 1,500), and 150 grams of ethanol were mixed and kneaded in a ball mill for two days. The resulting mixture was coated on a carbon conductively treated paper in a film thickness of about 8 $\mu$ by a coating rod and allowed to dry in order to form a recording layer. The recording paper was then subjected to recording by application of electricity. A tungsten stylus was connected to positive electrode and the carbon layer was connected to negative electrode. A voltage of about 150 volts was applied and the stylus was acanned at a speed of 1 meter per second.

As a result, the portion at which the stylus was scanned formed green color and an excellent image was obtained. At that time, a maximum recording current was 30mA and no liberation of odor and gas was observed.

EXAMPLE 2

Various kinds of recording papers were prepared in the same manner as described in Example 1 except that a various kinds of image forming agents were used in place of leuco-malachite green and then they were subjected to recording by application of electricity. The results were tarbulated in Table I below.

Table I

| Image forming agent | Recording ability | Recorded color | Polarity of stylus |
|---|---|---|---|
| Leuco Auramine | ○ | Yellow | ⊕ |
| 3,6-Di(dimethylamino)xanthene | ◎ | Red | ⊕ |
| 3,7-Diamino-5-phenyl-5,10-dihydrophenazine | ◎ | Red | ⊕ |
| 3,7-Di(dimethylamino)phenothiazine | ◎ | Blue | ⊕ |
| 4-Methoxy-1-naphtol | ◎ | Blue | ⊕ |
| Bis(p-dimethylaminophenyl)methane | ○ | Blue | ⊕ |
| Leuco Crystal Violet | ◎ | Blue-Purple | ⊕ |
| Bis(3-methyl-4-hydroxy-5-carboxyphenyl)-2,6-dichlorophenyl methane | ◎ | Red-Purple | ⊕ |
| 3,6-Diamino-2,7-dimethyl-9-phenylacridan | ○ | Red | ⊕ |
| 3,7-Di(diethylamino)phenoxazine | ◎ | Blue | ⊕ |
| Indigo White | ◎ | Dark-Blue | ⊕ |
| p-Aminodiphenyl amine | ◎ | Dark-Blue | ⊕ |
| 1-Methyl-2-2',4'-dinitrobenzyl piridinium-p-toluene sulfonate | ◎ | Purple-Blue | ⊖ |
| Dibromo phenol sulfophthalane | ◎ | Red | ⊖ |
| Phenolphthalein | ○ | Red | ⊖ |
| Triphenyl tetrazoiium chloride | ◎ | Red | ⊖ |
| Ditetrazorium chloride | ◎ | Dark Blue | ⊖ |

Table I-continued

| Image forming agent | Recording ability | Recorded color | Polarity of stylus |
|---|---|---|---|
| Nickel oxalate | ○ | Gray-Brown | ⊖ |
| Cobaltuns carbonate | ○ | Gray-Brown | ⊖ |
| Silver behenate | ○ | Gray-Brown | ⊖ |
| Phospho tungustatic acid | ◎ | Gray-Black | ⊖ |
| Nickel hypophosphite | ○ | Gray-Brown | ⊖ |
| Zinc oxide | ◎ | Gray-Black | ⊖ |

Note:
◎ . . . Excellent
○ . . . Good

EXAMPLE 3

Two grams of ditetrazorium chloride, 10 grams of polyvinyl butyral (degree of polymerization of 1,500), 150 grams of ethanol and 30 grams of one member selected from the following geolitic water containing compounds as listed in Table II below were mixed and kneaded for two days. The resulting mixture was coated on an aluminum laminated paper by coating rod in a thickness of about 10 $\mu$ and dried at 100°C for 5 minutes. Then, the recording paper was subjected to recording by application of electricity. Tungusten stylus and the aluminum layer were connected to negative and positive electrodes, respectively. DC voltage of about 150 volts was applied and the stylus was scanned at a speed of 1 m/sec. The results are shown in Table II.

Table II

| Geolitic water containing Compounds | Recording ability |
|---|---|
| Hydrosodalite | Δ |
| Faujasite | ◎ |
| Chabazite | Δ |
| Gmelinite | O |
| Erionite | O |
| Levynite | O |
| Weddellite | O |
| Molecular Sieve SK-40 | ◎ |
| Molecular Sieve 13× | ◎ |
| Molecular Sieve 5A | O |
| Analcite | Δ |
| Pollucite | Δ |
| Viseite | Δ |
| Kehoesite | Δ |
| Harmotome | Δ |
| Phillipsite | O |
| Gismondite | Δ |
| Garronite | O |
| Mordenite | Δ |
| D'achiardite | Δ |
| Ferrierite | O |
| Zeolon | O |
| Natrolite | Δ |
| Mesolite | Δ |
| Scolecite | Δ |
| Thomsonite | O |
| Edingtonite | Δ |
| Gonnardite | O |
| Rhodesite | Δ |
| Mountainite | Δ |
| Clinoptilotite | Δ |
| Paulingite | Δ |
| Bikitaite | Δ |
| Cancrinite | Δ |
| Scorodite | Δ |
| Psilomelane | Δ |
| Rutile type titanium* oxide | X |
| No addition* | X |

*Comparative Examples

Rutile type titanium oxide does not contain geolitic water.

◎ . . . Excellent
O . . . Good
Δ . . . Recording observed
X . . . No recording observed The maximum recording currents were corresponding to the above recording abilities.

◎ . . . about 25 to 35 mA
O . . . about 15 to 25 mA
Δ . . . about 5 to 15 mA
X . . . substantially 0 mA

EXAMPLE 4

Synthetic zeolite (U.C.C., Molecular Sieve SK-40) . . . . 30g
Rutile titanium oxide . . . . . 10g
Acrylic resin (Toa Gosei Co. Ltd. Aron S 1001. . . . 20g
Toluene/MEK = 1/1 . . . . . 100g
Leucomalachite green . . . . . 3g These ingredients were kneaded in a ball mill for two days and coated on aluminum vapor depositted paper in a thickness of about 12 $\mu$ by a coating rod. Recording was carried out by DC voltage of 150 volts.

The aluminum layer and stylus were connected to negative and positive electrodes, respectively. Good green color was obtained.

EXAMPLE 5

Two layer recording paper as shown in FIG. 2 was prepared.

Composition of conductive layer

Synthetic Zeolite (U.C.C., Molecular sieve SK 40) ... . . . 30g
Acrylic resin (Toa Gosei Co. Ltd., Aron S-1001)
Toluene/MEK = 1/1 . . . . . 70g These ingredients were kneaded in ball mill for two days and coated on an aluminum vapor-depositted paper in a thickness of about 10 $\mu$ to form a conductive layer.

Composition of Recording Layer

Triphenyltetrazorium chloride . . . . . 2g
Synthetic zeolite (Molecular sieve 13x) . . . . . 5g
Polyvinyl butyral (degree of polymerization of 4,000) . . . . . 2g
Ethanol . . . . . 20g These ingredients were kneaded in ball mill for two days and coated on the above conductive layer with coating rod in a thickness of about 5 $\mu$.

To the thus prepared sheet was applied a DC voltage of about 150v, the stylus was connected to the negative electrode and aluminum layer was connected to positive electrode. When the stylus was scanned at a speed of 2m/sec, electricity of about 20 mA flowed and thus a good red image was obtained.

EXAMPLE 6

When 3 grams of polyvinyl alcohol (degree of polymerization of 1,000, degree of saponification of 85%) was used in place of polyvinylbutyral in Example 5, an excellent red image was obtained.

At recording, neither odor nor gas was observed.

EXAMPLE 7

Crystal Violet Lact one . . . . . 5g
Synthetic zeolite (U.C.C., Molecular Sieve 13x) . . . . . 5g
Rutyl type titanium oxide . . . . . 1g
Polyvinylalcohol (degree of polymerization of 1,000, degree of saponification of 85%) . . . . . 3g
Water . . . . . 12g These ingredients were kneaded in ball mill for two days to produce component A.

Bisphenol A . . . . . 5g
Synthetic zeolite (U.C.C., Molecular Sieve 13x) . . . . . 5g
Polyvinyl alcohol (degree of polymerization of 1,000, degree of saponification of 85%) . . . . . 3g
Water . . . . . 12g These ingredients were kneaded in ball mill for two days to form Component B. Then Components A and B were coated on an aluminum vapor-depositted paper in a thickness of about 8 $\mu$ by coating rod. After drying, recording was effected. In this case, the stylus and the aluminum vapordepositted paper were connected to negative and positive electrodes, respectively. Voltage of about 250 volts was applied and the stylus was scanned and thus a blue image was obtained.

EXAMPLE 8

Synthetic zeolite (U.C.C., Molecular Sieve SK-40) . . . . . 30g
Silver behenate . . . . . 7g
Protocatechuic acid . . . . . 1.5g
Polyvinyl butyral . . . . . 12g
Ethanol . . . . . 130g A dispersion containing the above ingredients was coated on an aluminum vapor-depposited paper in a thickness of about 10 $\mu$ by a coating rod thereby providing a recording paper. DC voltage of about 150 volts was applied, and the stylus and the aluminum vapor-depositted layer were connected to negative and positive layers, respectively. On scanning the stylus, electricity of about 30 mA flowed and excellent color forming was obtained by Joule's heat.

EXAMPLE 9

An overlay paper was dipped in a mixture of Components A and B and allowed to dry to provide a recording paper. The recording paper was adhered to aluminum plate and positive and negative electrodes of power source were connected to the aluminum layer and the stylus, respectively. On scanning the stylus while applying voltage of about 350 volts, blue image was obtained.

EXAMPLE 10

Two-color recording paper was prepared in accordance with the following procedure.

Synthetic zeolite (U.C.C., Molecular Sieve SK-40) . . . . . 30g
Rutyl type titanium oxide . . . . . 5g
Color former A (which forms color when the stylus is connected to positive electrode) . . . . . 2g
Color former B (which forms color when the stylus is connected to negative electrode) . . . . . 2g
Polyvinyl butyral (degree of polymerization of 1,500) . . . . . 10g
Ethanol . . . . . 150g These ingredients were kneaded in a ball mill for two days and coated on an aluminum laminated paper in a film thickness of about 8 $\mu$. After allowing to dry, electricity was applied. By changing polarity of the stylus while connecting the aluminum laminated surface to ground, a two color recorded paper was obtained. Color formers A and B used herein are as listed in Table III below.

Table III

| Color former A | | Color former B | |
|---|---|---|---|
| Name | Recorded color | Name | Recorded color |
| 4-Methoxy-1-naphthol | Blue | Tripenyltetrazorium chloride | Red |
| Leuco auramine | Yellow | Ditetra zorium chloride | Dark Blue |
| 3,6-Di(dimethylamino) xanthene | Red | Phosphotungstic acid | Gray-Black |
| 3,7-Diamino-5-phenyl-5-10 dihydrophenazine | Red | Tetrazorium violet | Dark-Purple |
| 3,7-Di(dimethylamino) phenazine | Blue | Silver beherate | Gray-Brown |
| Leuco malachite green | Green | 2,4,6-Trinitrobenzoate | Brown |

We claim:

1. In an electrical recording member provided with a recording layer consisting essentially of an image-forming agent, an electrically-conductive agent and a binder therefor, the improvement comprising said electrically-conductive agent comprising at least a compound containing zeolitic water, whereby an image is formed in said recording layer by the application thereto of electrical current.

2. The electrical recording member according to claim 1 wherein the recording layer comprises a single layer composed of at least one zeolitic water-containing compound, an image-forming agent and a binder therefor.

3. The electrical recording member according to claim 1 wherein the recording layer comprises an electrically-conductive layer containing at least one zeolitic water-containing compound, and an image-forming layer containing at least one image-forming agent.

4. An electrical recording member according to claim 1 wherein the zeolitic water-containing compound is a zeolite mineral.

5. An electrical recording member according to claim 1 wherein the zeolitic water-containing compound is a silicate compound containing zeolitic water.

6. An electrical recording member according to claim 1 wherein the amount of said zeolitic water-containing compound in said recording layer is from 30 to 98% by weight, based upon the total weight of the recording layer.

7. An electrical recording member according to claim 1 wherein the amount of said zeolitic water-containing compound in said recording layer is from 70 to 90% by weight, based upon the total weight of the recording layer.

8. An electrical recording member according to claim 4 wherein the zeolite material is from the analcime group.

9. An electrical recording member according to claim 4 wherein the zeolite mineral is from the sodalite group.

10. An electrical recording member according to claim 4 wherein the zeolite mineral is from the chabazite group.

11. An electrical recording member according to claim 4 wherein the zeolite mineral is from the natrolite group.

12. An electrical recording member according to claim 4 wherein the zeolite mineral is from the harmotome group.

13. An electrical recording member according to claim 4 wherein the zeolite mineral is from the mordenite group.

14. A process for electrically recording an image in an electrical recording member by the application of electrical current thereto, which comprises applying electrical current to a recording layer of said electrical recording member wherein said recording layer consists essentially of an electrically-conductive agent composed of at least one compound containing zeolitic water, an image-forming agent and a binder therefor.

15. A process according to claim 14 wherein the zeolitic water-containing compound is a zeolite mineral.

16. A process according to claim 14 wherein electrical current is applied from a stylus to said recording layer.

17. An electrical recording member according to claim 1 wherein said zeolitic water-containing compound is a natural zeolite of the formula:

$$[M^{+2}, (M^{+1})_2]O \cdot Al_2O_3 \cdot m\,SiO_2 \cdot nH_2O$$

wherein $M^{+2}$ and $M^{+1}$ represent, respectively, divalent and monovalent metal ions which are replaceable with other cations, $m$ is from 3 to 10 and $n$ is a positive integer.

18. An electrical recording member according to claim 1 wherein said zeolitic water-containing compound is a synthetic zeolite.

19. An electrical recording member according to claim 1 wherein said image-forming agent is a compound which is capable of forming an image in response to a change of energy caused by the application of the electrical current thereto, and is selected from the group consisting of an oxidation-type color former, a reduction-type color former, a pH indicator and a heat-sensitive color former.

20. An electrical recording member according to claim 1 wherein said binder is selected from the group consisting of gelatin, natural polymers, cellulose derivatives, semi-synthetic polymers, polymerization-type synthetic polymers, condensation polymerization-type synthetic polymers and addition polymerization-type synthetic polymers.

21. An electrical recording member according to claim 1 wherein said recording layer is provided on a substrate.

* * * * *

UNITED STATES PATENT OFFICE

CERTIFICATE OF CORRECTION

Patent No. 3,936,361 Dated February 3, 1976

Inventor(s) YASUSHI TAKATORI, ET AL.

It is certified that error appears in the above-identified patent and that said Letters Patent are hereby corrected as shown below:

Column 5, line 13, (Table line 15), change "IV) IV)" to read -- IV) Three --;

Column 7, line 44, after "metal" insert -- , thin metal,--;

Column 8, line 12, change "combined" to --combine--;

Column 10, line 47, after "Aron S-1001)" insert -- ... 15g --;

Column 12, line 5, insert --a-- before "blue";

Column 12, line 65, delete "mineral";

Column 13, lines 16, 19, 22, 25 and 28, delete "mineral";

Column 14, lines 2-3, delete "mineral".

Signed and Sealed this

Sixth Day of July 1976

[SEAL]

*Attest:*

RUTH C. MASON
*Attesting Officer*

C. MARSHALL DANN
*Commissioner of Patents and Trademarks*